United States Patent [19]

Kikuchi et al.

[11] Patent Number: 4,778,348

[45] Date of Patent: Oct. 18, 1988

[54] SLANT PLATE TYPE COMPRESSOR WITH VARIABLE DISPLACEMENT MECHANISM

[75] Inventors: Sei Kikuchi, Isesaki; Takai Kazuhiko, Maebashi; Higuchi Teruo; Kiyoshi Terauchi, both of Isesaki, all of Japan

[73] Assignee: Sanden Corporation, Gunma, Japan

[21] Appl. No.: 76,282

[22] Filed: Jul. 22, 1987

[30] Foreign Application Priority Data

Jul. 23, 1986 [JP] Japan ..... 61-111994[U]

[51] Int. Cl.[4] ..... F04B 1/28

[52] U.S. Cl. ..... 417/222; 417/270

[58] Field of Search ..... 417/218, 222, 270

[56] References Cited

U.S. PATENT DOCUMENTS

| | | | |
|---|---|---|---|
| Re. 27,844 | 11/1968 | Olsen | 417/269 |
| 862,867 | 3/1906 | Eggleston . | |
| 2,530,507 | 10/1945 | Campbell . | |
| 2,573,863 | 5/1948 | Mitchell . | |
| 2,964,234 | 5/1954 | Loomis . | |
| 3,861,829 | 4/1973 | Roberts | 417/269 |
| 4,037,993 | 4/1976 | Roberts | 417/222 |
| 4,073,603 | 2/1976 | Abendschein | 417/222 |
| 4,145,163 | 9/1977 | Fogelberg | 417/222 |
| 4,157,233 | 6/1979 | Horiuchi | 417/218 |
| 4,174,191 | 1/1978 | Roberts | 417/222 |
| 4,425,837 | 9/1981 | Livesay | 417/269 |
| 4,428,718 | 2/1982 | Skinner | 417/222 |
| 4,433,596 | 3/1981 | Scalzo | 74/60 |
| 4,475,871 | 8/1982 | Roberts | 417/222 |
| 4,492,527 | 2/1983 | Swain | 417/222 |
| 4,526,516 | 2/1983 | Swain | 417/222 |
| 4,557,670 | 12/1985 | Inagaki | 417/299 |
| 4,586,874 | 5/1986 | Hiraga . | |
| 4,637,419 | 8/1987 | Suzuki | 417/270 |
| 4,664,604 | 5/1987 | Terauchi | 417/270 |
| 4,669,272 | 6/1987 | Kawai | 417/270 |
| 4,702,677 | 10/1987 | Takenaka | 417/276 |

FOREIGN PATENT DOCUMENTS

| | | |
|---|---|---|
| 0219283 | 4/1987 | European Pat. Off. . |
| 3603931 | 7/1986 | Fed. Rep. of Germany . |
| 2153922A | 8/1985 | United Kingdom . |

*Primary Examiner*—William L. Freeh

*Attorney, Agent, or Firm*—Banner, Birch, McKie & Beckett

[57] ABSTRACT

A slant plate type compressor, such as a wobble plate type compressor, with a variable displacement mechanism for use in a refrigeration circuit is disclosed. Two passageways communicate between the crank chamber and the suction chamber in the cylinder block. A bellows is disposed in a first passageway and controls communication between the crank chamber and the suction chamber in the first passageway. The bellows operates in accordance with the crank chamber pressure. A control valve is disposed in the second passageway and controls communication between the crank chamber and the suction chamber in the second passageway in response to signal from an external sensor. This configuration enables the compressor to be operated at maximum capacity when the refrigeration circuit is turned on until the temperature in the passenger compartment of a car reaches a desired temperature without input from the pressure in the crank chamber. After the temperature in the passenger compartment of the car reaches the desired temperature, the compressor operation is controlled by the bellows based on the crank chamber pressure. Therefore, the cooling characteristics of the compressor are improved and the temperature in the passenger compartment of the car can be controlled better.

4 Claims, 2 Drawing Sheets

SLANT PLATE TYPE COMPRESSOR WITH VARIABLE DISPLACEMENT MECHANISM

TECHNICAL FIELD

The present invention relates to an improved refrigerant compressor for an automotive air conditioner. More particularly, the present invention relates to a slant plate type compressor, such as a wobble plate type compressor, with a variable displacement mechanism suitable for use in an automotive air conditioning system.

BACKGROUND OF THE INVENTION

One construction of a slant plant type compressor, particularly a wobble plate compressor, with a variable capacity mechanism which is suitable for use in an automotive air conditioner is disclosed in the U.S. Pat. No. 3,861,829 issued to Roberts et al. Robers et al. '829 discloses a wobble plate type compressor which has a cam rotor driving device to drive a plurality of pistons. The slant or incline angle of the slant surface of the wobble plate is varied to change the stroke length of the pistons which changes the displacement of the compressor. Changing the incline angle of the wobble plate is effected by changing the pressure difference between the suction chamber and the crank chamber in which the driving device is located.

In such a prior art compressor, the slant angle of the slant surface is controlled by the pressure in the crank chamber. Typically this control occurs in the following manner. The crank chamber communicates with the suction chamber through an aperture and the opening and closing of the aperture is controlled by a valve mechanism. The valve mechanism generally includes a bellows element and a needle valve, and is located in the suction chamber so that the bellows element operates in accordance with changes in the suction chamber pressure.

In the above compressor, the pressure in the suction chamber is compared with a predetermined value by the valve mechanism. However, when the predetermined value is below a certain critical value, there is a possibility of frost forming on the evaporator in the refrigerant circuit. Thus, the predetermined value is usually set higher than the critical value to prevent frost from forming on the evaporator.

However, since suction pressures above this critical value are higher than the pressure in the suction chamber when the compressor operates at maximum capacity, the cooling characteristics of the compressor are inferior to those of the same compressor without a variable displacement mechanism. This deficiency is shown graphically in FIG. 2.

Roberts et al, '829 discloses a capacity adjusting mechanism used in a wobble plate type compressor. As is typical in this type of compressor, the wobble plate is disposed at a slant or incline angle relative to the drive axis, nutates but does not rotate, and drivingly couples the pistons to the drive source. This type of capacity adjusting mechanism, using selective fluid communication between the crank chamber and the suction chamber can be used in any type of compressor which uses a slanted plate or surface in the drive mechanism. For example, U.S. Pat. No. 4,664,604 issued to Terauchi discloses this type of capacity adjusting mechanism in a swash plate type compressor. The swash plate, like the wobble plate, is disposed at a slant angle and drivingly couples the pistons to the drive source. However, while the wobble plate only nutates, the swash plate both nutates and rotates. The term slant plate type compressor will therefore be used to refer to any type of compressor, including wobble and swash plate types, which use a slanted plate or surface in the drive mechanism.

SUMMARY OF THE INVENTION

It is a primary object of this invention to provide a slant plate type compressor with a variable displacement mechanism which can better control the temperature in a passenger compartment of a vehicle.

It is another object of this invention to provide a slant plate type compressor with a variable displacement mechanism which has improved cooling characteristics.

A slant plate type compressor in accordance with the present invention includes a compressor housing having a front end plate at one of its ends and a rear end plate at its other end. A crank chamber and a cylinder block are located in the housing, and a plurality of cylinders are formed in the cylinder block. A piston is slidably fitted within each of the cylinders and is reciprocated by a driving mechanism. The driving mechanism includes a drive shaft, a drive rotor coupled to the drive shaft and rotatable therewith, and a coupling mechanism which drivingly couples the rotor to the pistons such that the rotary motion of the rotor is converted to reciprocating motion of the pistons. The coupling mechanism includes a member which has a surface disposed at an incline angle relative to the drive shaft. The incline angle of the member is adjustable to vary the stroke length of the reciprocating pistons and thus vary the capacity or displacement of the compressor. The rear end plate surrounds a suction chamber and a discharge chamber. Two passageways provide fluid communication between the crank chamber and the suction chamber. Two incline angle control devices are supported in the compressor. The first incline angle control device controls the incline angle of the coupling mechanism member in response to the pressure conditions in the compressor. The second incline angle control device controls the incline angle of the coupling mechanism member in response to a control signal from outside of the compressor. The first incline angle control device has a first valve and a first valve control mechanism. The first valve controls communication between the crank chamber and the suction chamber through the first passageway. The first valve control mechanism controls the operation of the first valve to open and close the first passageway in response to the refrigerant pressure in the suction chamber. The second incline angle control mechanism has a second valve and a second valve control mechanism. The second valve controls communication between the crank chamber and the suction chamber through the second passageway. The second valve control mechanism controls the operation of the second valve to open and close the second passageway in response to the control signal from a sensor sensing the temperature in the passenger compartment of a car.

Various additional advantages and features of novelty which characterize the invention are further pointed out in the claims that follow. However, for a better understanding of the invention and its advantages, reference should be made to the accompanying drawings and descriptive matter which illustrate and describe a preferred embodiment of the invention.

DETAILED DESCRIPTION OF A PREFERRED EMBODIMENT

Figure 1:
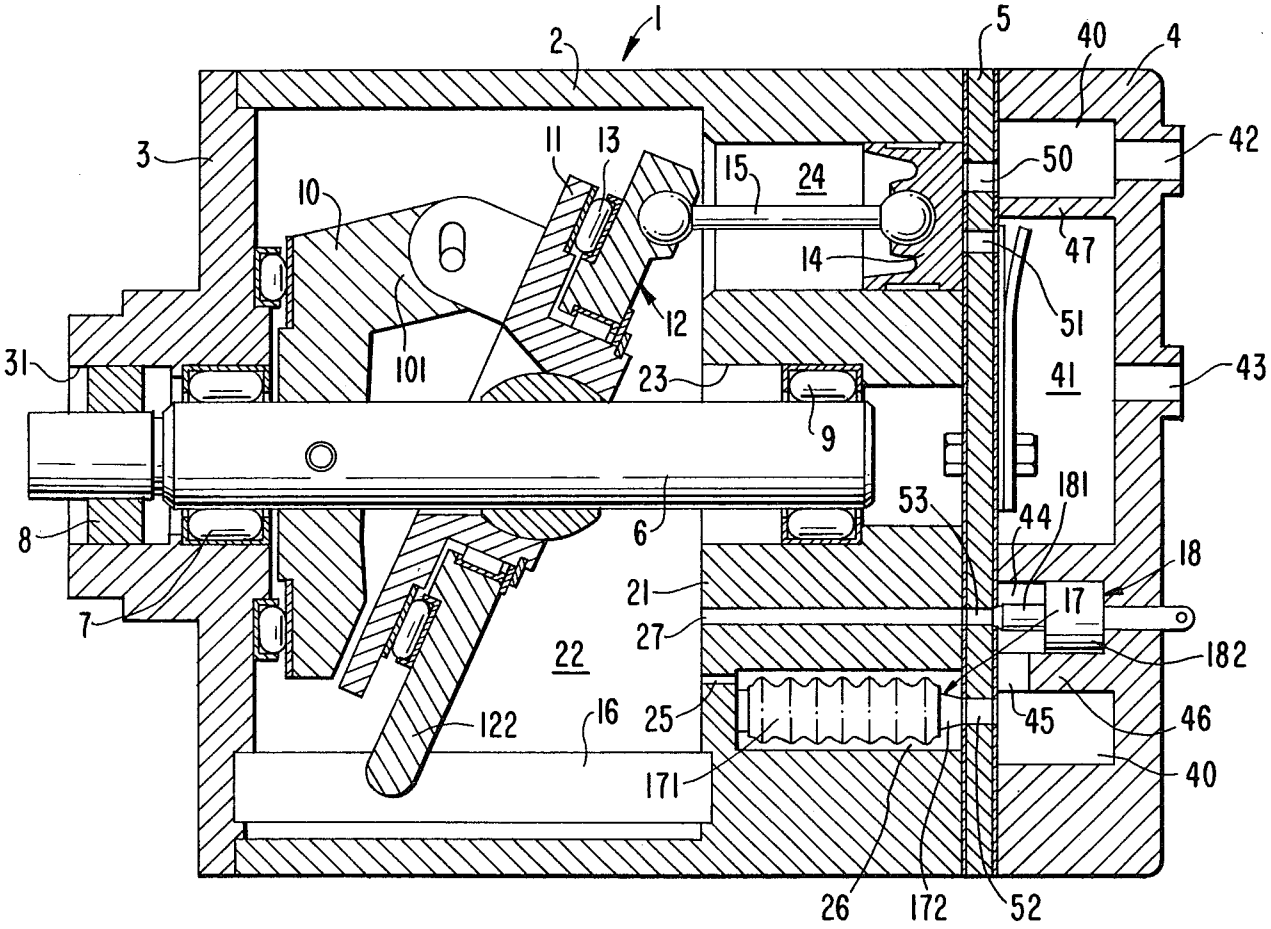
FIG. 1 is a cross-sectional view of a slant plate type compressor with a variable displacement mechanism in accordance with this invention.

With reference to FIG. 1, the construction of a slant plate type compressor, specifically a wobble plate type compressor, with a variable displacement mechanism according to this invention is shown. Compressor 1 includes a closed housing assembly formed by cylindrical compressor housing 2, front end plate 3 and a rear end plate in the form of cylinder head 4. Cylinder block 21 and crank chamber 22 are located in compressor housing 2. Front end plate 3 is attached to one end surface of compressor housing 2, and cylinder head 4, which is disposed on the other end surface of compressor housing 2, is fixed on one end surface of cylinder block 21 through valve plate 5. Opening 31 is formed in the central portion of front end plate 3 to receive drive shaft 6.

Drive shaft 6 is rotatably supported on front end plate 3 through bearing 7. Shaft seal 8 is disposed between the inner surface of opening 31 and the outer surface of drive shaft 6 at the outside of bearing 7. An inner end portion of drive shaft 6 extends into central bore 23 formed in the central portion of cylinder block 21 and is rotatably supported therein by bearing 9. Rotor 10, which is disposed in the interior of crank chamber 22, is connected to drive shaft 6 to be rotatable therewith and engages inclined plate 11 on one side surface through hinge portion 101. The incline angle of inclined plate 11 with respect to drive shaft 6 can be adjusted by hinge portion 101. Wobble plate 12 is disposed on the other side surface of inclined plate 11 and bears against it through bearing 13.

A plurality of cylinders 24, one of which is shown in FIG. 1, are equiangularly formed in cylinder block 21, and piston 14 is slidably disposed within each cylinder 24. Each piston 14 is connected to wobble plate 12 through a connecting rod 15. One end of each connecting rod 15 is connected to wobble plate 12 with a ball joint and the other end of each connecting rod 15 is connected to one of pistons 14 with a ball joint. Guide bar 16 extends within crank chamber 22 of compressor housing 2. The lower end portion of wobble plate 12 engages guide bar 16 to enable wobble plate 12 to reciprocate along guide bar 16 while preventing rotating motion.

Pistons 14 are thus reciprocated in cylinders 24 by a drive mechanism formed of drive shaft 6, rotor 10, inclined plate 11, wobble plate 12 and connecting rods 15. Drive shaft 6 and rotot 10 rotate. Inclined plate 11 nutates and rotates, and wobble plate 12 nutates only. Inclined plate 11, wobble plate 12 and connecting rods 15 function as a coupling mechanism to convert the rotating motion of the rotor into reciprocating motion of the pistons.

Cylinder head 4 has an interior space divided into at least two chambers, suction chamber 40 and discharge chamber 41. Suction chamber 40 and discharge chamber 41 are divided by partition wall 47, and both chambers communicate with cylinders 24 through suction hole 50 or discharge hole 51 formed through valve plate 5, respectively. Also, cylinder head 4 is provided with inlet port 42 and outlet port 43 which place suction chamber 40 and discharge chamber 41 in fluid communication with an external refrigerant circuit.

First passageway 25 is formed in cylinder block 21 to communicate between suction chamber 40 and crank chamber 22 through hollow portion 26 formed in cylinder block 21 and first communication hole 52 formed thorough valve plate 5. The communication between chambers 40 and 22 is controlled by bellows 17. Bellows 17 is located in hollow portion 26 and includes bellows element 171 and needle valve 172. One end surface of bellows element 171 is attached to one inner end surface of hollow portion 26. Needle valve 172 is fixed on the other end surface of bellows element 171 and operates to open and close first communication hole 52 in accordance with the motion of bellows element 171.

Second passageway 27 is formed in cylinder block 21 to communicate between suction chamber 40 and crank chamber 22 through second communication hole 53 formed through valve plate 5. A control chamber 44 is formed in suction chamber 40 of cylinder head 4 by divided wall 46 and is connected with suction chamber 40 through third communication hole 45 formed through divided wall 46. Control valve 18 is disposed in control chamber 44 and includes needle valve 181 and solenoid actuator 182. Solenoid actuator 182 is fixed on one inner end surface of control chamber 44. Needle valve 181 is attached to the other end surface of solenoid actuator 182 and opens and closes second communication hole 53 in accordance with the operation of solenoid actuator 182.

Figure 2:
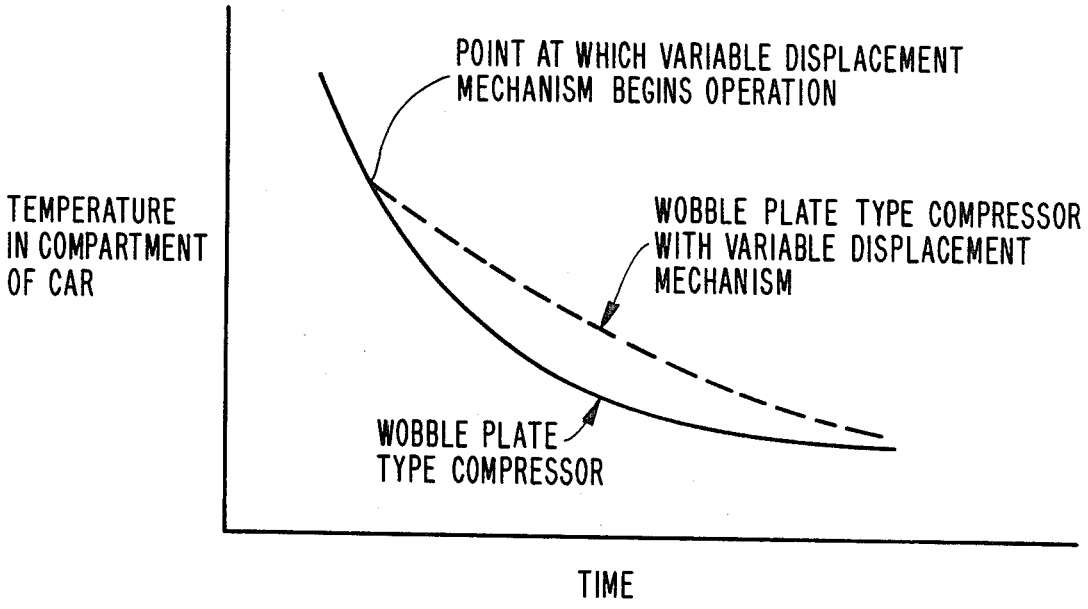
FIG. 2 is a graph comparing the relationship between time and the temperature in a passenger compartment of a car for an air conditioning system using a slant plate type compressor without any variable displacement mechanism and a slant plate type compressor with a conventional variable displacement mechanism.

When solenoid actuator 182 is not energized, needle valve 181 closes second communication hole 53. Accordingly, the pressure in crank chamber 22 is determined by the operation of bellows 17. If the pressure in crank chamber 22 is lower than the stiffness of bellows element 171, bellows element 171 pushes or biases needle valve 172 toward the right in FIG. 2 os that needle valve 172 closes first communication hole 52 of valve plate 5. Thus, communication between suction chamber 40 and crank chamber 22 through first passageway 26 is obstructed. The pressure in crank chamber 22 gradually increases, because blow-by gas leaks into crank chamber 22 through a gap between the inner wall surface of cylinder 24 and the outer wall surface of piston 14. Gas pressure in crank chamber 22 acts on the rear surface of pistons 14, and the balance of momentum on inclined plated 11 relative to drive shaft 6 is thereby decreased. This decreases the stroke of pistons 14. As a result, the volume of refrigerant gas taken into cylinder 24 decreases and the capacity of the compressor decreases.

On the other hand, if the pressure in crank chamber 22 exceeds the stiffness of bellows element 171, needle valve 172 moves toward the left against the inherent stiffness or bias of bellows element 171 and opens first communication chamber 52 of valve plate 5. Accordingly, crank chamber 22 is in fluid communication with suction chamber 40 through first passageway 25. The refrigerant gas in crank chamber 22 flows into suction chamber 40 through first passageway 25, hollow portion 26 and first communication hole 52. The gas pressure acting on the rear surface of pistons 14 decreases in accordance with the decreasing gas pressure in crank chamber 22. The balance of momentum on inclined plate 11 increases and the angle of inclined plate 11 relative to drive shaft 6 likewise increases. The stroke of pistons 14 increases, the volume of refrigerant gas being compressed increases, and the capacity of the compressor increases.

When solenoid actuator 182 is energized, solenoid actuator 182 attracts needle valve 181 toward the right, and needle valve 181 opens second communication hole 53 of valve plate 5. Accordingly, crank chamber 22 is placed in fluid communication with control chamber 44 through second passageway 27 and second communication hole 53. Crank chamber 22 thus communicates with suction chamber 40, because control chamber 44 is always in fluid communication with suction chamber 40 through third communication hole 45. Therefore, crank chamber 22 is placed in fluid communication with suction chamber 40 independently of whether bellows element 171 opens or closes first communication hole 52. Crank chamber 22 communicates with suction chamber 40 even though needle valve 172 closes first communication hole 52. The pressure on the rear of pistons 14 decreases and the balance of momentum acting on inclined plate 11 is thus increased. The stroke of pistons 14 also increases and, as a result, the volume of refrigerant gas taken into cylinders 24 is increased. Thus, the capacity of the compressor increases.

When an air conditioning system including this compressor is turned on, a signal activates solenoid actuator 182. Needle valve 181 moves to the left to open second communication hole 53 and the compressor operates at maximum capacity until the temperature in the passenger compartment of the car decreases to the desired temperature. When the temperature in the compartment of the car reaches the desired level, the signal which operates solenoid valve 182 ceases and needle valve 181 moves to close second communication hole 53. The communication between crank chamber 22 and suction chamber 40 may then be controlled by the operation of bellows 17. In this compressor, the pressure in suction chamber 40 is controlled by bellows 17 and may be set to prevent frost formation in the evaporator of the refrigeration circuit.

Numerous characteristics and advantages of the invention have been described in detail in the foregoing description with reference to the accompanying drawings. However, the disclosure is illustrative only and the invention is not limited to the precise illustrated embodiment. Various changes and modifications may be effected therein by one skilled in the art without departing from the scope or spirit of the invention.

We claim:

1. In a slant plate type refrigerant compressor for use in a refrigeration circuit, said compressor including a compressor housing having a central portion, a front end plate at one end and a rear end plate at its other end, said housing having a cylinder block provided with a plurality of cylinders and a crank chamber adjacent said cylinder block, a piston slidably fitted within each of said cylinders, a drive mechanism coupled to said pistons to reciprocate said pistons within said cylinders, said drive mechanism including a drive shaft rotatably supported in said housing, a rotor coupled to said drive shaft and rotatable therewith, and coupling means for drivingly coupling said rotor to said pistons such that the rotary motion of said rotor is converted into reciprocating motion of said pistons, said coupling means including a member having a surface disposed at an incline angle relative to said drive shaft, said incline angle of said member being adjustable to vary the stroke length of said pistons and the capacity of said compressor, said rear end plate having a suction chamber and a discharge chamber, a first passageway disposed within said compressor housing connected between said crank chamber and said suction chamber and first valve means for controlling the opening and closing of said first passageway to vary the capacity of the compressor by adjusting the incline angle, said first valve means comprising a first valve to directly open and close said first passageway and first valve controm means for controlling the movement of said first valve to open and close said first passageway in response to changes in refrigerant pressure in said compressor, the improvement comprising:

a second passageway disposed within said compressor housing connected between said crank member and said suction chamber and second valve means for controlling the opening and closing of said second passageway to vary the capacity of said compressor by adjusting the incline angle, said second valve means comprising a second valve to directly open and close said second passageway and override the operation of said first valve and second valve control means for controlling the movement of said second valve to open and close said second passageway in response to a signal from outside the compressor.

2. The refrigerant compressor of claim 1 wherein said first valve means comprises a bellows.

3. The refrigerant compressor of claim 2 wherein said bellows comprises a bellows element and a needle valve.

4. The refrigerant compressor of claim 1 wherein said second valve control means comprises a solenoid actuator and a needle valve.

* * * * *

UNITED STATES PATENT AND TRADEMARK OFFICE

CERTIFICATE OF CORRECTION

PATENT NO. : 4,778,348

DATED : October 18, 1988

INVENTOR(S) : Sei Kikuchi et al.

It is certified that error appears in the above-identified patent and that said Letters Patent is hereby corrected as shown below:

Column 1, line 15, delete "plant" and insert —plate—;
Column 1, line 19, delete "Robers" and insert —Roberts—;
Column 3, line 61, delete "rotot" and insert —rotor—;
Column 4, line 13, delete "thorough" and insert —through—;
Column 4, line 43, delete "os" and insert —so—;
Column 4, line 46, delete "26" and insert —25—;
Column 6, Claim 1, line 28, delete "controm" and insert —control—; and
Column 6, Claim 1, line 34, delete "member" and insert —chamber—.

Signed and Sealed this

Thirty-first Day of December, 1991

*Attest:*

HARRY F. MANBECK, JR.

*Attesting Officer*

*Commissioner of Patents and Trademarks*